US006132855A

United States Patent [19]

Becher et al.

[11] Patent Number: 6,132,855

[45] Date of Patent: Oct. 17, 2000

[54] DULL CAST COATED PAPER AND METHOD FOR MANUFACTURING THEREOF

[75] Inventors: Joachim Becher, Nümbrecht; Franz Josef Berghausen, Bergisch Gladbach; Hans Peter Fröhlich, Bergisch Gladbach; Thomas Grosser, Bergisch Gladbach; Ulrich Heckes, Kürten; Gerd Papier, Kürten Eichhof; Ralf Gisbert Baran, Wermelskirchen, all of Germany; Helmut Benda, Cikaraug, Indonesia

[73] Assignee: Zanders Feinpapiere AG, Germany

[21] Appl. No.: 09/122,101

[22] Filed: Jul. 24, 1998

[30] Foreign Application Priority Data

Dec. 15, 1997 [DE] Germany ..... 197 55 724

[51] Int. Cl.[7] ..... B32B 7/02; B32B 5/16; B32B 29/00

[52] U.S. Cl. ..... 428/219; 428/323; 428/341; 428/537.5

[58] Field of Search ..... 428/141, 143, 428/153, 219, 220, 323, 325, 340, 341, 342, 411.1, 500, 688, 689, 161, 162, 537.5

[56] References Cited

U.S. PATENT DOCUMENTS

| | | | |
|---|---|---|---|
| 5,902,770 | 5/1999 | Narita et al. | 503/227 |
| 5,922,457 | 7/1999 | Yanagisawa et al. | 428/342 |

FOREIGN PATENT DOCUMENTS

| | | |
|---|---|---|
| 767273 | 4/1997 | European Pat. Off. . |
| 04108199 | 4/1992 | Japan . |
| 95/05505 | 2/1995 | WIPO . |

OTHER PUBLICATIONS

Japanese Abst. Appl. No. 3–62042.
Japanese Abst. Appl. No. 5–36984.

*Primary Examiner*—Paul Thibodeau
*Assistant Examiner*—Sheeba Ahmed
*Attorney, Agent, or Firm*—Keil & Weinkauf

[57] ABSTRACT

A cast-coated paper has, on at least one coated surface of a base paper, a coat containing pigment(s) and binder and having low gloss. The coat has a topographical surface profile in which the average peak-to-valley height $R_a$ is from 0.1 $\mu$m to 0.5 $\mu$m and the maximum peak-to-valley height $R_t$ is from 1.0 $\mu$m to 4.5 $\mu$m, and the wave height $W_t$ is less than 5.0 $\mu$m. In a process for the production of a cast-coated paper having low gloss, an aqueous coating composition which contains pigment(s) and binder is applied to at least one surface of a base paper, the coated surface is brought into contact with the surface of a heated cylinder, the coat is dried in contact with the cylinder surface and the dried paper is removed from the cylinder surface. The cylinder surface has the topographical surface profile in which the average peak-to-valley height $R_a$ is from 0.1 $\mu$m to 0.6 $\mu$m and the maximum peak-to-valley height $R_t$ is from 1.0 $\mu$m to 5.0 $\mu$m. The surface gloss R'(75°) of the cast-coated paper according to the invention is less than 30 (measuring angle 75°), measured according to DIN 54502.

18 Claims, No Drawings

DULL CAST COATED PAPER AND METHOD FOR MANUFACTURING THEREOF

FIELD OF THE INVENTION

The invention relates to coated paper having a very uniform surface and low gloss, whose specific volume is not reduced by calendering, in particular coated paper obtainable by means of cast-coating processes.

PRIOR ART

According to the teaching of U.S. Pat. No. 2,919,205, high gloss can be avoided in cast coating if the coating is first gelled by means of an acid bath before drying and not dried completely in contact with the highly glossy cylinder surface but removed beforehand and then dried with hot air to conventional residual moisture content. Gloss values (Bausch & Lomb gloss meter) of 70 and 72 are stated. The uncompacted dry coating is very even. Papers which are not matte but highly glossy are obtained by this process. The gloss of these papers in the region of "supercalendered gloss-coated papers", namely, according to DIN 54502 R'(45°)>10 at a measuring angle of 45°.

DE-C-43 27 366 describes a cast-coated paper whose gloss is from 58 to 68% at a measuring angle of 20°. This gloss is achieved by coating compositions which contain form 70 to 100 parts by weight of kaolin and/or talc and from 10 to 14 parts by weight, based on 100 parts by weight, of a latex having a Tg>18° C. and from 6 to 10 parts by weight of starch ether and a crosslinking agent. In addition, up to 20 parts by weight of other pigments customary in paper coating slips may be used. The papers obtained by this process are also not matte.

DE-C-195 37 427 discloses a cast-coated paper having a matte surface. The matte surface is achieved by using milled $CaCO_3$ in which at least 60% by weight have a particle size>2 μm in combination with a starch ether as a binder in the coat. The gloss (measured at 20°) is less than 5%; at a measuring of 45°, the gloss is less than 20%. The roughness of the surface, measured by the Parker Print Surf method, is < or =1.8 μm. The claimed ranges in DE-C-195 37 427 for gloss and smoothness also include very slightly glossy, matte and smooth papers, although these have the disadvantage that they are obtained only with the use of special coating compositions and very coarse-particled pigments.

According to the prior art, matte surfaces of coated papers are also produced by treatment with calenders, the coated paper surface being brought into contact with the surface of matte steel rollers. However, compaction of the coated paper is effected by the simultaneous application of pressure.

In general, matte surfaces of coated papers can be achieved according to the prior art by coating the papers with coating slips which contain coarse pigments. However, these papers all have the disadvantage that their surfaces are relatively non-uniform and have disadvantageous surface profiles. The result of this is, inter alia, that printing ink films printed on them have only very little resistance to mechanical stress, such as, for example, rubbing of the surface of two printed papers against one another.

SUMMARY OF THE INVENTION

It is the object of the present invention to provide a coated paper having a uniform surface which has little gloss, and a production process suitable for this purpose.

The object is achieved by a cast-coated paper which has, on at least one surface of a base paper, a coating containing pigment(s) and binder and having little gloss, when the surface gloss R'(75°) according to DIN 54502 is less than 30 (measuring angle 75°) and the surface of the coating has a profile (measured with the surface tester "Hommel Tester") in which the average peak-to-valley height $R_a$ is from 0.1 μm to 0.5 μm and the maximum peak-to-valley height $R_t$ is from 1.0 μm to 4.5 μm, and the wave height $W_t$ is less than 5.0 μm.

The solution includes also a process for the production of a cast-coated paper having little gloss, by applying an aqueous coating composition which contains pigment(s) and binder to at least one surface of a base paper, bringing the coated surface into contact with the surface of a heated cylinder and drying the coating in contact with the cylinder surface and removing the dried paper from the cylinder surface, when the surface of the cylinder has a profile (measured using the surface tester Hommel Tester) in which the average peak-to-valley height $R_a$ is from 0.1 μm to 0.6 μm and the maximum peak-to-valley height $R_t$ is from 1.0 μm to 5.0 μm and the surface gloss R'(75°) of the cast-coated paper according to DIN 54502 is less than 30 (measuring angle 75°) and the cast-coated surface has a profile (measured using the surface tester "Hommel Tester") in which the average peak-to-valley height $R_a$ is from 0.1 μm to 0.5 μm and the maximum peak-to-valley height $R_t$ is from 1.0 μm to 4.5 μm, and the wave height $W_t$ is less than 5.0 μm.

DETAILED DESCRIPTION OF THE INVENTION

Preferably, the cast-coated paper according to the invention has a coated surface with a profile (measured using the surface tester "Hommel Tester") in which the average peak-to-valley height $R_a$ is from 0.2 μm to 0.4 μm and the maximum peak-to-valley height $R_t$ is from 1.5 μm to 3.5 μm, and the wave height $W_t$ is less than 4.0 μm.

The surface gloss of the coated paper according to DIN 54502 (75°) is preferably less than 25, very particularly preferably between 5 and 17.

The "Hommel Tester" from Hommelwerke, D 78056 Villingen-Schwenningen, is a surface probe in which a diamond probe tip having a tip radius of 5 μm is passed over the sample surface to be measured, with very little surface pressure. The deflection of the probe tip caused by the surface profile is measured inductively. The roughness parameters which are specified by DIN and ISO standards are determined from the profile curve recorded. $R_a$ is the average peak-to-valley height according to DIN 4768/1, $R_t$ is the maximum peak-to-valley height according to DIN 4762/1E and $W_t$ is the wave height according to DIN 4774. The roughness parameters are stated in the dimension μm.

The surface smoothness of the cast-coated paper according to the invention can also be determined by the Parker Print Surf method (PPS) according to DIN-ISO 8791-4. In the case of the low gloss achieved according to the invention, the roughness according to the Parker Print Surf method is in the range from 0.70 μm to 1.20 μm, preferably from 0.70 μm to 1.10 μm.

The cast coated papers according to the invention have the advantage that they can be produced with the same finely divided coating compositions and pigments which are also used for the production of the known high-gloss cast-coated papers. This simplifies the sequences in the production facility. A particular characteristic of the cast coated papers according to the invention is the uniformity of the matte surface. This is evident from the measured topographical surface profile which differs from the surface profile of all known matte and smooth coated papers.

The cast-coated paper according to the present invention may also have a coat on both sides of the base paper.

The cast-coated paper according to the invention may have a basis weight of from 60 to 400 g/m$^2$, preferably from 80 to 250 g/m$^2$.

An advantage of the paper according to the invention, produced by cast coating and having a matte surface, is that the paper was not compacted and therefore has a lower density than conventional papers rendered matte by calendering. The cast-coated paper according to the invention may have a density of from 0.80 to 1.00 g/cm$^3$.

The aqueous coating slip is applied to the base paper in an amount such that the coating weight after drying (oven-dry) is from 10 to 30 g/cm$^2$. A coating weight (oven-dry) of from 10 to 25 g/m$^2$ is preferred.

The aqueous coating slip or coating composition contains one or more pigments and one or more binders and may additionally contain assistants and additives customary in paper coating compositions.

Suitable pigments are, for example, clay, kaolin, aluminum hydroxide, satin white, barium sulfate, milled calcium carbonate, precipitated calcium carbonate, talc, calcined kaolin, titanium dioxide, plastic pigments, etc., which may be used alone or as mixtures. Finely divided pigments having particle size distributions in which at least 50% by weight have a particle size <2 $\mu$m are preferred.

Table 1 shows typical particle size distributions of pigments which may be used in the aqueous coating compositions.

TABLE 1

| $\mu$m diameter | % cumulative mass finer | | | | | |
|---|---|---|---|---|---|---|
| 2 | 82.0 | 90.5 | 60.4 | 94.8 | 53.8 | 52.9 |
| 4 | 91.4 | 97.6 | 86.3 | 99.2 | 73.6 | 71.8 |
| 6 | 96.6 | 99.0 | 95.9 | 99.8 | 86.4 | 85.3 |
| 8 | 98.4 | 99.2 | 98.4 | 99.8 | 92.2 | 92.6 |
| 10 | 98.8 | 99.3 | 99.1 | 99.9 | 95.7 | 95.9 |
| | Ultra Gloss[1)] | Ansilex 93[1)] | Hydrocarb 60[2)] | HCC Slurry[2)] | SPS[3)] | China Clay B[3)] |

[1)]Engelhard Corporation
[2)]Pluss-Staufer AG
[3)]ECC International Limited

The particle sizes of the pigments were measured by a gravity sedimentation process, in particular with the use of an apparatus sold by Micromeritics Instrument Corp. under the trade name "SediGraph 5100 V3.01 Particle Size Analysis System".

The aqueous coating composition contains binders customary in paper coating compositions, with the exception of starch or starch derivatives. Customary suitable binders are, for example, synthetic polymer latices, such as styrene/butadiene latex, methyl methacrylate/butadiene latex, styrene/vinyl acetate latex, vinyl acetate/acrylate latex, styrene/acrylate/acrylonitrile latex; water-soluble binders, such as casein, soybean protein, polyvinyl alcohol and suitable copolymer latices, which may be used individually or as mixtures with one another.

From 10 to 30 parts by weight of binder may by used per 100 parts by weight of pigment(s).

For example, dispersants and wetting agents, parting or releasing agents, viscosity modifiers, agents for increasing water resistance, preservatives, dyes and antifoams and ammonium salts or metal salts of inorganic or organic acids, pH adjusters, etc. may be concomitantly used as customary assistants and additives for aqueous paper coating slips.

The oven-dry solids content of the aqueous coating composition to be applied to the base paper may be from 25 to 60% by weight, based on the total weight of the aqueous coating composition, preferably from 30 to 50% by weight, and depends on the method of application by means of which the coating slip is applied to the web of the base paper and is metered. This may be effected by means of a blade, roll, air-knife, rod or engraved coating apparatus, etc.

The invention also includes a process for the production of a cast-coated paper having little gloss, by applying an aqueous coating composition which contains pigment(s) and binder to at least one surface of a base paper, bringing the coated surface into contact with the surface of a heated cylinder and drying the coating in contact with the cylinder surface and removing the dried paper from the cylinder surface, wherein the surface of the cylinder has a profile (measured using the surface tester Hommel Tester) in which the average peak-to-valley height $R_a$ is from 0.1 $\mu$m to 0.6 $\mu$m and the maximum peak-to-valley height $R_t$ is from 1.0 $\mu$m to 5.0 $\mu$m and the surface gloss R'(75°) of the cast-coated paper according to DIN 54502 is less than 30 (measuring angle 75°) and the cast-coated surface has a profile (measured using the surface tester "Hommel Tester") in which the average peak-to-valley height $R_a$ is from 0.1 $\mu$m to 0.5 $\mu$m and the maximum peak-to-valley height $R_t$ is from 1.0 $\mu$m to 4.5 $\mu$m, and the wave height $W_t$ is less than 5.0 $\mu$m.

To characterize the surface profile of the cylinder surface, it is actually not necessary to state the wave height since it is very small. It is less than 2.0 $\mu$m, preferably less than 1.0 $\mu$m. The use of a cylinder surface having a profile in which the average peak-to-valley height $R_a$ is from 0.2 $\mu$m to 0.5 $\mu$m and the maximum peak-to-valley height $R_t$ is from 1.5 $\mu$m to 4.5 $\mu$m is particularly preferred.

The cast coating process according to the present invention produces a coated surface which essentially corresponds to the surface of the glazing cylinder. This is also the case with the use of a matte cylinder having a specific roughness profile, it being possible for the coated surface to have a slightly smaller maximum peak-to-valley height and a slightly smaller average peak-to-valley height. The elasticity of the paper may also result in a slightly higher wave height than the wave height of the cylinder surface, which helps to characterize the surface profile of the coating.

Before being brought into contact with the cylinder surface, the aqueous coating slip applied to the base paper may be coagulated and/or solidified to a gel by exposing the coating composition layer to a coagulation or gelling bath. The coagulation methods which may be used to set the coat also include heat coagulation and/or heat gelling, in which spontaneous solidification of the coating slip layer occurs, for example as a result of heating with hot air. A heat-sensitive coating slip is obtained by adding an appropriate amount of, for example, salts which contain divalent or polyvalent metal cations and whose dissociation increases under the action of heat. Compared with the direct method which operates without coagulation and gelling of the coating slip layer, higher cylinder temperatures (>100° C.) can be used in the coagulation or gel method, so that the layer can be more rapidly formed and dried when brought into contact with the cylinder.

It is also possible first to dry the coating slip applied to the base paper and to remoisten the coated surface with water before simultaneously being brought into contact with the surface of the heated cylinder (indirect method). As a result of the remoistening, the dry coating slip layer achieves the plastic gel state which permits defect-free reproduction of the cylinder surface and defect-free drying on the hot cylinder surface. In comparison with the direct method and with the coagulation method, however, the moisture content of the layer which is achieved by remoistening and the plasticity of said layer are slightly lower, so that the remoistened layer may require a higher contact pressure on the hot cylinder surface.

In order to achieve sufficient plastication of the remoistened layer, but also to achieve easy removability of the layer from the cylinder in the dried state, the aqueous remoistening solution may contain the known additives customary for this process. Customary additives are release agents, such as polyethylenes, ethoxylated polyethylenes, waxes, metal and ammonium salts of aliphatic acids, ketene dimers, surfactants based on fatty acids, sulfonated and sulfated oils and fatty acid triglycerides, and dispersants, and, if required pH adjusters.

The heated cylinder surface may have a temperature of from 80 to 160° C. In all cast-coating processes (direct, gel and indirect method), there is the danger that water evaporating too rapidly in the interior of the base paper and in the layer may tear and damage the paper structure and/or the coat. In the so-called direct method in which the moist, ungelled coating slip is brought into contact with the heated cylinder surface, temperatures below 100° C. are preferred because experience has shown that in this method the danger of excessively high rates of evaporation of the water and of damage to the paper is very great.

In procedures in which the applied coating slip is coagulated and solidified to a gel or first dried and then remoistened before being brought into contact with the cylinder surface, temperatures above 100° C. are preferred because the danger of excessively high evaporation rates which damage the paper and the coat is substantially eliminated by greater contact pressure on the coated paper by means of an elastic pressure roll. In the indirect method, this danger is substantially eliminated such that the highest production rates can be achieved by said method.

In procedures in which the applied coating slip is coagulated and solidified to a gel or first dried and then remoistened before being brought into contact with the cylinder surface, contact pressures≧1000 N/cm (nip pressure) in which the coated paper is pressed against the cylinder surface by means of a roll are preferred. The use of high contact pressure permits higher web speeds and leads to high production rates.

The cylinder surface may also be such that only regions of the surface of the cylinder have the surface profile characterized by average peak-to-valley height $R_a$ and maximum peak-to-valley height $R_t$ and other regions are smoother and have a higher gloss than the regions having the characterizing profile. With the use of a cylinder of this type, the paper according to the invention can be provided with decorative extensive gloss-matte contrasts. Gloss-matte contrasts can also be in the form of watermark-like markings or identifications visible in reflected light, for example in the form of images and text characters, such as trademarks, logos etc.

The base paper required for the production of the matte cast-coated paper according to the invention is not subject to any special restrictions. The base paper may be an acidic or neutral or alkaline paper: it may be precoated on one or both sides with a customary pigment coating composition and it can, if required, be calendered in the precoated state by supercalendering, brushing, etc. Any preliminary coat applied is preferably from 5 to 20 g/m$^2$.

Compared with the prior art, the cast coated paper according to the invention has advantages in its resistance to mechanical stress, such as, for example, to the rubbing of the surfaces of papers against one another (abrasion resistance), where in the printed state visible damage to the printed image may occur. In practical printing and finishing processes, for example, relative movement of paper sheets in contact under slight pressure frequently results in abrasion of printing ink from printed paper surfaces by unprinted paper surfaces with simultaneous ink transfer to the unprinted paper. Even when two printed papers are pressed together briefly, there may be both visible damage to the printed image and ink transfer to the contact paper (carbonation), which is considered aesthetically to reduce the value of the printed object. The better resistance of the paper according to the invention compared with the papers according to the prior art to damage by these mechanical stresses is determined by an abrasion test and by a carbonation test.

Abrasion Test Method

In an abrasion tester (type "Quartant" from Prüfbau, D 82380 Peißenberg), an unprinted paper surface is rubbed against a printed one. The ink transfer to the unprinted paper surface as a result of abrasion is rated visually by means of a scale with the ratings 1 (very good) to 5 (very poor). The test results are shown in Table 2.

Carbonation Test Method

In a carbonation tester (tester from FOGRA, Deutsche Forschungsgesellschaft Druck, 81604 Munich) a printed paper surface and an unprinted one are pressed together under high pressure. The ink transfer to the unprinted paper is rated visually by means of a scale with the ratings 1 (very good) to 5 (very poor). The test results are shown in Table 2.

Compared with the prior art, the paper according to the invention furthermore has advantages with respect to the print gloss. Print gloss is the gloss on the resulting ink surface after printing of the paper. As a rule, there is an increase in gloss ("print gloss enhancement") whose extent is dependent, inter alia, on the relevant paper properties. It is considered by an observer of the printed paper to constitute an enhancement of the aesthetic value of the printed image.

Print Gloss Test Method

The paper is printed in full tone with a commercial sheet offset ink on a proof printer (from Prüfbau, D 82380 Peißenberg). The test results are shown in Table 2.

TABLE 2

| Paper sample | Gloss[1)] R'(75) | Roughness PPS[2)] | Print gloss enhancement[3)] | Abrasion test[4)] | Carbonation test[5)] |
|---|---|---|---|---|---|
| 1A | 10.8 | 0.95 | 23.2 | 1 | 2–3 |
| 1B | 11.4 | 0.87 | 26.9 | 1 | 2 |
| 1C | 12.7 | 0.93 | 26.2 | 1 | 2 |
| 1D | 16.7 | 0.73 | 27.6 | 1 | 2 |
| 2A | 9.4 | 1.07 | 23.4 | 1–2 | 3 |
| 2B | 9.7 | 0.74 | 23.1 | 1–2 | 2 |
| 3A | 10.6 | 1.01 | 25.0 | 1 | 2 |
| 3B | 10.7 | 0.86 | 26.7 | 1 | 2 |
| V1 | 1.9 | 4.85 | 4.1 | | |
| V2 | 3.3 | 4.45 | 7.3 | 3 | 4 |
| V3 | 5.6 | 4.01 | 4.9 | | |
| V4 | 6.9 | 2.36 | 12.1 | 3–4 | 4 |
| V5 | 7.5 | 1.87 | 6.0 | | |

TABLE 2-continued

| Paper sample | Gloss[1)] R'(75) | Roughness PPS[2)] | Print gloss enhancement[3)] | Abrasion test[4)] | Carbonation test[5)] |
|---|---|---|---|---|---|
| V6 | 8.1 | 2.06 | 12.7 | 4 | 5 |
| V7 | 14.0 | 2.09 | 6.0 | | |

[1)]unprinted paper surface, DIN 54502, measuring angle 75°
[2)]unprinted paper surface, Parker Print Surf method; DIN-ISO 8791-4
[3)]difference between R'(75) of printed surface and R'(75) of unprinted surface
[4)]"Quartant" abrasion test
[5)]FOGRA carbonation test The samples of Series 1 were produced by the procedure of Example 1 below. The samples of Series 2 were produced by the procedure of Example 2 below. The samples of Series 3 were produced by the procedure of Example 3 below. V1 to V7 are commercial matte coated papers.

Table 3 contains the roughness parameters, obtained by means of a "Hommel Tester", of the chromium-plated matte cylinder, of the samples of Series 1 to 3 obtained therewith analogously to Examples 1 to 3 and of conventional matte papers V1 to V7 according to the prior art.

TABLE 3

| Surface, sample | $R_a$ μm | $R_t$ μm | $W_t$ μm |
|---|---|---|---|
| Cylinder | 0.35 | 2.94 | 0.95 |
| 1A | 0.26 | 2.31 | 1.40 |
| 1B | 0.26 | 2.47 | 1.59 |
| 1C | 0.25 | 2.37 | 1.26 |
| 1D | 0.24 | 2.12 | 1.71 |
| 2A | 0.31 | 2.98 | 1.78 |
| 2B | 0.33 | 3.69 | 3.15 |
| 3A | 0.26 | 2.22 | 1.28 |
| 3B | 0.27 | 2.37 | 1.54 |
| V1 | 1.66 | 15.05 | 8.66 |
| V2 | 1.34 | 10.26 | 7.98 |
| V3 | 1.23 | 9.23 | 8.08 |
| V4 | 0.93 | 7.81 | 5.45 |
| V5 | 0.73 | 5.63 | 3.60 |
| V6 | 0.72 | 5.62 | 3.97 |
| V7 | 0.55 | 4.67 | 3.25 |

The invention is illustrated in more detail with reference to examples. The amounts of substances used are stated as in "parts". "Parts" are to be understood as: parts by weight of oven-dry substance (oven-dry substance is obtainable by drying the relevant substance in an oven at a drying temperature of 105° C.). The statement "parts of water" is not affected by this definition. Example 1 was carried out by the remoistening method, Example 2 by the gel method and Example 3 by the direct method.

EXAMPLE 1

A pigment mixture comprising 20 parts of satin white and 80 parts of commercial clay is dispersed with a stirred vessel with the addition of 4 parts of protein, 0.2 part of sodium polyacrylate dispersant, 0.1 part of sodium hydroxide solution, 1.2 parts of calcium hydroxide and 0.01 part of antifoam in the presence of 114 parts of water with formation of a pigment slurry having a concentration of 48% by weight, based on oven-dry substance. 20 parts of a commercial carboxylated styrene/butadiene copolymer as a binder, 0.3 part of an optical brightener and sufficient water to give a coating slip having a concentration of 44% by weight, based on oven dried substance, are added to the pigment slurry. The pH of the coating slip is adjusted to 11.5 with sodium hydroxide solution. The coating slip is applied in excess to the base paper, which has a basis weight of 202 g/m$^2$. By means of an air-knife, excess coating slip is removed in an amount such that the amount which corresponds to 24 g/m$^2$ dry weight (oven-dried) remains on the base paper. Thereafter, the coated paper is dried with hot air to a moisture content of 8% and is passed into a roll nip formed from a cylinder having the surface profile to be used according to the invention and an elastic pressure roll. There, the dry paper coat is moistened by contact with the aqueous remoistening solution, which is present in the roll nip, fed through feed nozzles and contains stearic acid, ammonium stearate and paraffin wax in a concentration of 0.5% by weight, and the coated side is pressed against the matte, chromium-plated surface of the cylinder at a temperature of 150° C. and nip pressure of 1000 N/cm. The web speed is 150 m/min. The web dried on the cylinder is removed from the cylinder by a deflecting roll and then rolled up. The paper obtained from Example 1 (Sample 1B) has a gloss R'(75°) of 11.4 at a measuring angle of 75°. The surface profile of the paper, measured with the "Hommel Tester", has an average peak-to-valley height $R_a$=0.26 μm, a maximum peak-to-valley height $R_t$=2.47 μm and a wave height $W_t$=1.59 μm.

EXAMPLE 2

A mixture of 100 parts of commercial clay and 16 parts of protein is dispersed using a stirred vessel with the addition of 0.5 part of sodium hydroxide solution, 2 parts of ammonia in the presence of 202 parts of water with formation of a pigment slurry having a concentration of 37% by weight oven-dry. 9 parts of a commercial styrene/butadiene copolymer as binder, 0.4 part of paraffin wax and 2 parts of calcium stearate as release agent, 0.2 part of optical brightener and an amount of water such that a coating strip which has a concentration of 35% by weight of oven dry and a pH of 10.0 are added to the pigment slurry. The coating slip is applied in excess to the base paper which has a basis weight of 202 g/m$^2$. By means of an air-knife, excess coating slip is removed and the amount which corresponds to 12 g/m$^2$ dry weight (oven-dried) remains on the base paper. Thereafter, the coating slip layer is coagulated in contact with an aqueous solution which contains 5% by weight of formic acid. The coated side of the paper is then pressed, in a roll nip formed from a cylinder having the surface profile to be used according to the invention and an elastic roll, against the matte, chromium-plated surface of the cylinder at a temperature of 150° C. and a nip pressure of 1000 N/cm. The web speed is 40 m/min. The web dried on the cylinder is removed from the cylinder by a deflecting roll and then rolled up. The paper obtained from Example 2 (paper sample 2A) has a gloss R'(75) of 9.4 at a measuring angle of 75°. The surface profile of the paper, measured with the "Hommel Tester", has an average peak-to-valley height $R_a$=0.31 μm, a maximum peak-to-valley height $R_t$=2.98 μm and a wave height $W_t$=1.78 μm.

EXAMPLE 3

A mixture of 100 parts of commercial clay and 10 parts of protein is dispersed using a stirred vessel with the addition of 1.0 part of sodium hydroxide solution, 0.3 part of sodium polyacrylate dispersant in the presence of 111 parts of water with formation of a pigment slurry having a concentration of 50% by weight oven-dry. 12 parts of a commercial styrene/butadiene copolymer as binder and 2 parts of calcium stearate as release agent, 0.2 part of optical brightener and an amount of water such that a coating strip which has a concentration of 45% by weight of oven dry and a pH of 9.5 are added to the pigment slurry. The coating slip is applied in excess to the base paper which has a basis weight of 202 g/m$^2$. By means of an air-knife, excess coating slip is removed and the amount which corresponds to 26 g/m$^2$ dry weight (oven-dried) remains on the base paper. The coated side of the paper is then pressed, in a roll nip formed from a cylinder having the surface profile to be used according to the invention and an elastic roll, against the matte, chromium-plated surface of the cylinder at a temperature of 85° C. and a nip pressure of 600 N/cm. The web speed is 45 m/min. The web dried on the cylinder is removed from the cylinder by a deflecting roll and then rolled up. The paper obtained from Example 3 (paper sample 3A) has a gloss R'(75) of 10.6 at a measuring angle of 75°. The surface profile of the paper, measured with the "hommel tester", has an average peak-to-valley height $R_a$=0.26 $\mu$m, a maximum peak-to-valley height $R_t$2.22 $\mu$m and a wave height $W_t$=1.28 $\mu$m.

What is claimed is:

1. A cast-coated paper which has, on at least one surface of a base paper, a coating containing pigment(s) and binder and having a surface gloss R'(75°) according to DIN 54502 of less than 30 at a measuring angle 75° and the surface of the coating has a profile measured with a Hommel Tester in which the average peak-to-valley height $R_a$ is from 0.1 $\mu$m to 0.5 $\mu$m and the maximum peak-to-valley height $R_t$ is from 1.0 $\mu$m to 4.5 $\mu$m, and the wave height $W_t$ is less than 5.0 $\mu$m.

2. The cast-coated paper as claimed in claim 1, which coated paper has a basis weight of from 60 g/m$^2$ to 400 g/cm$^2$.

3. The cast-coated paper as claimed in claim 2, which coated paper has density of from 0.80 g/cm$^3$ to 1.00 g/cm$^3$.

4. The cast-coated paper as claimed in claim 1, wherein the oven-dry coat weight of the coated paper is from 10 g/m$^2$ to 30 g/m$^2$.

5. The cast-coated paper as claimed in claim 1, wherein the pigment or pigments contained in the coat has or have a particle size distribution in which at least 50% by weight of the particles have a particle size of less than 2 $\mu$m.

6. The cast-coated paper as claimed in claim 1, wherein only certain regions of the coat have a low gloss and a surface profile characterized by the maximum peak-to-valley height $R_t$ and the wave height $W_t$ and wherein other regions are smoother and have a gloss R'(45°) according to DIN 54502 of more than 15 at a measuring angle of 45°.

7. The cast-coated paper as claimed in claim 1, which has a density of from 0.80 g/cm$^3$ to 1.00 g/cm$^3$.

8. The cast-coated paper as claimed in claim 2, wherein the oven-dry coat weight of the coated paper is from 10 g/m$^2$ to 30 g/m$^2$.

9. The cast-coated paper as claimed in claim 3, wherein the oven-dry coat weight of the coated paper is from 10 g/m$^2$ to 30 g/m$^2$.

10. The cast-coated paper as claimed in claim 2, wherein the pigment or pigments contained in the coat has or have a particle size distribution in which 50% by weight of the particles have a particle size of less than 2 $\mu$m.

11. The cast-coated paper as claimed in claim 3, wherein the pigment or pigments contained in the coat has or have a particle size distribution in which 50% by weight of the particles have a particle size of less than 2 $\mu$m.

12. The cast-coated paper as claimed in claim 4, wherein the pigment or pigments contained in the coat has or have a particle size distribution in which 50% by weight of the particles have a particle size of less than 2 $\mu$m.

13. The cast-coated paper as claimed in claim 9, wherein the pigment or pigments contained in the coat has or have a particle size distribution in which 50% by weight of the particles have a particle size of less than 2 $\mu$m.

14. The cast-coated paper as claimed in claim 2, wherein only certain regions of the coat have a low gloss and a surface profile characterized by the maximum peak-to-valley height $R_t$ and the wave height $W_t$ and wherein other regions are smoother and have a gloss R'(45°) according to DIN 54502 of more than 15 at a measuring angle of 45°.

15. The cast-coated paper as claimed in claim 3, wherein only certain regions of the coat have a low gloss and a surface profile characterized by the maximum peak-to-valley height $R_t$ and the wave height $W_t$ and wherein other regions are smoother and have a gloss R'(45°) according to DIN 54502 of more than 15 at a measuring angle of 45°.

16. The cast-coated paper as claimed in claim 4, wherein only certain regions of the coat have a low gloss and a surface profile characterized by the maximum peak-to-valley height $R_t$ and the wave height $W_t$ and wherein other regions are smoother and have a gloss R'(45°) according to DIN 54502 of more than 15 at a measuring angle of 45°.

17. The cast-coated paper as claimed in claim 5, wherein only certain regions of the coat have a low gloss and a surface profile characterized by the the maximum peak-to-valley height $R_t$ and the wave height $W_t$ and wherein other regions are smoother and have a gloss R'(45°) according to DIN 54502 of more than 15 at a measuring angle of 45°.

18. The cast-coated paper as claimed in claim 13, wherein only certain regions of the coat have a low gloss and a surface profile characterized by the maximum peak-to-valley height $R_t$ and the wave height $W_t$ and wherein other regions are smoother and have a gloss R'(45°) according to DIN 54502 of more than 15 at a measuring angle of 45°.

* * * * *